US006731888B2

(12) United States Patent
Suzuki et al.

(10) Patent No.: US 6,731,888 B2
(45) Date of Patent: May 4, 2004

(54) IMAGE FORMING CONTROL USING DENSITY DETECTION

(75) Inventors: Kazuo Suzuki, Kanagawa (JP); Nobuhiko Zaima, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/190,508

(22) Filed: Jul. 9, 2002

(65) Prior Publication Data

US 2003/0012577 A1 Jan. 16, 2003

(30) Foreign Application Priority Data

Jul. 12, 2001 (JP) ..... 2001-212077

(51) Int. Cl.[7] ..... G03G 15/08
(52) U.S. Cl. ..... 399/49; 399/60
(58) Field of Search ..... 399/49, 60

(56) References Cited

U.S. PATENT DOCUMENTS 5,809,366 A * 9/1998 Yamakawa et al. ..... 399/39

* cited by examiner

*Primary Examiner*—Quana M. Grainger
(74) *Attorney, Agent, or Firm*—Fitzpatrick, Cella, Harper & Scinto

(57) ABSTRACT

An image forming method includes: forming a first control image on an image bearing member by an image forming device; detecting the density of the first image by a detecting sensor; forming a second control image lower in target density level than the first image on the image bearing member by the image forming device; and detecting the density of the second image by the detecting sensor, wherein the image forming device forms the second image to be larger than the first image.

18 Claims, 7 Drawing Sheets

DENSITY SAMPLING POINTS

FIG. 9
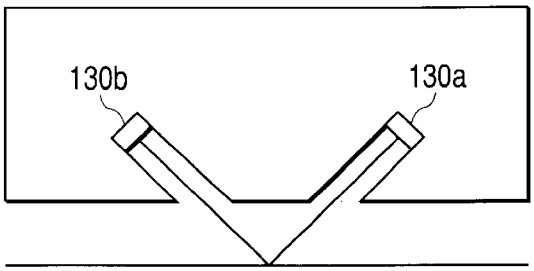
FIG. 10
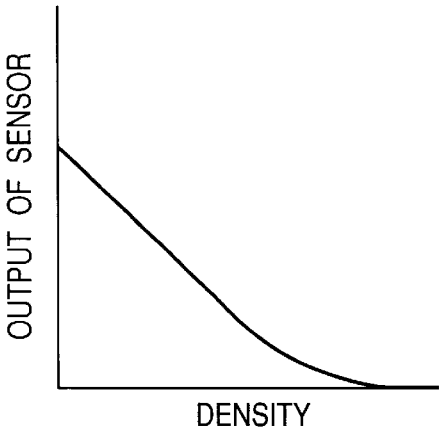
FIG. 11
| IMAGE RATE [%] | 10 | 20 | 30 | 40 | 50 | 60 | 70 | 80 | 90 | 100 |
|---|---|---|---|---|---|---|---|---|---|---|
| LENGTH OF TONER IMAGE [mm] | 30 | 29 | 28 | 27 | 26 | 25 | 24 | 23 | 22 | 20 |

IMAGE FORMING CONTROL USING DENSITY DETECTION

BACKGROUND OF THE INVENTION

1. Field of the Invention

The present invention relates to an image forming method of forming a control image, an image detecting method of detecting it, and an image forming apparatus using the electrophotography or the electrostatic recording method. This image forming apparatus includes a copying machine, printer, and facsimile apparatus.

2. Description of Related Art

A conventional electrophotographic image forming apparatus forms a toner image on a photosensitive member and transfers the image onto a recording medium such as a sheet of paper. Image forming apparatuses which repeat this sequence to achieve multi layer transfer of images onto a recording medium, forming a full-color image are also available. As a development method, such an apparatus adopts a two-component development method.

The full-color image forming apparatus executes control for optimizing the density of a toner image formed every color image so as not to change the hue or tone of a formed image.

More specifically, the density of a patch image formed on a photosensitive member is detected by a density detecting sensor arranged around the photosensitive member. If the detection result is determined to be lighter than a predetermined value, the density of a toner image formed on the photosensitive member is adjusted to darken the image. If the detection result is determined to be darker than the predetermined value, the density of a toner image formed on the photosensitive member is adjusted to lighten the image.

A density detecting sensor 13 uses a near infrared ray LED as a light-emitting element and a photodiode as a light-receiving element. The density detecting sensor 13 detects regular reflection light from a toner image visualized on a photosensitive drum 1. The detected toner image density is controlled by adjusting image forming conditions (toner/carrier density (ratio in weight between toner and carrier), and a charging bias, exposure light quantity, and developing bias for forming an electrostatic latent image on the photosensitive member).

When a low-density toner image is detected by the density sensor, an output from the density sensor becomes unstable and the detection accuracy degrades under the influence of scratches or the like on the surface of the photosensitive drum, resulting in an image forming failure.

SUMMARY OF THE INVENTION

It is an object of the present invention to provide an image forming method, image detecting method, and image forming apparatus capable of increasing the density detection accuracy of a detecting sensor regardless of the target density level of a control image.

The above and other objects, features, and advantages of the present invention will be apparent from the following detailed description of the preferred embodiments in conjunction with the accompanying drawings.

BRIEF DESCRIPTION OF THE DRAWINGS

FIG. 9 is a schematic view showing a density sensor according to the second embodiment;

FIG. 10 is a graph showing the output of the sensor with respect to the density in the density sensor according to the second embodiment;

FIG. 11 is a table showing the image rate of a toner image to be detected in the third embodiment and the size of the toner image to be detected.

DETAILED DESCRIPTION OF THE PREFERRED EMBODIMENTS

An image density control apparatus and image forming apparatus according to the present invention will be described in detail below with reference to the accompanying drawings.

(First Embodiment)

Figure 2:
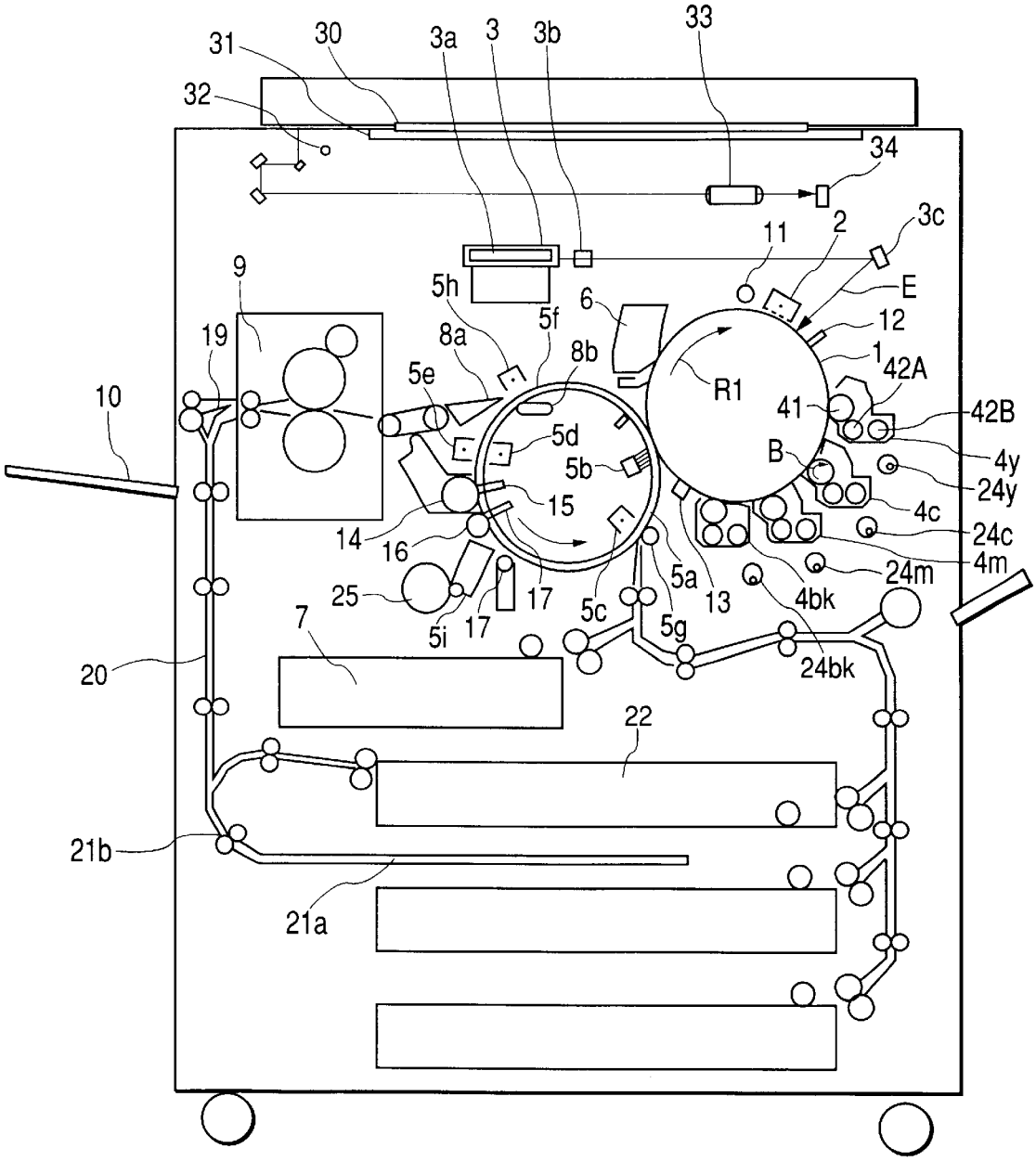
FIG. 2 is a sectional view showing the whole arrangement of an image forming apparatus according to the first embodiment.

FIG. 2 is a sectional view showing the schematic arrangement of a color image forming apparatus according to the first embodiment of the present invention.

The color image forming apparatus of the embodiment comprises a digital color image reader section in the upper part and a digital color image printer section in the lower part.

In the reader section, an original 30 is placed on an original glass stand 31, and a reflection light image of the original 30 exposed and scanned by an exposure lamp 32 is condensed on a full-color sensor 34 via a lens 33, obtaining color separation image signals. The color separation image signals are processed by a video processing unit (not shown) via an amplifier circuit (not shown), and transmitted to the printer section.

In the printer section, a photosensitive drum 1 as an image bearing member is held to rotate in a direction indicated by an arrow R1. The photosensitive drum 1 is surrounded by a pre-exposure lamp 11, a corona charger 2 as a charging means, an exposure optical system 3 as an exposure means, an electrostatic voltmeter 12, four developing devices 4*y*, 4*c*, 4*m*, and 4*bk* as developing means, a density detecting sensor 13, a transfer device 5 as a transfer means, and a cleaning device 6 as a cleaning means.

The laser beam exposure optical system 3 receives an image signal from the reader section and converts it into an optical signal by a laser output portion (not shown). A laser beam is reflected by a polygon mirror 3*a*, passes through a lens 3*b* and mirror 3*c*, and is converted into an optical image E which linearly scans (raster-scan) the surface of the photosensitive drum 1.

To form an image in the printer section, the photosensitive drum 1 is rotated in the direction indicated by the arrow R1, and charge-eliminated by the pre-exposure lamp 11. Then, the photosensitive drum 1 is uniformly charged by the corona charger 2 and irradiated with the optical image E for each separation color to form a latent image.

A predetermined developing device is operated for each separation color to develop the latent image on the photosensitive drum 1, and an image is formed from a toner containing a resin as a base on the photosensitive drum 1. The developing devices selectively come close to the photosensitive drum 1 in response to respective separation colors by the operation of eccentric cams 24*y*, 24*c*, 24*m*, and 24*bk*.

The toner image on the photosensitive drum 1 is transferred onto a recording medium supplied from a recording medium cassette 7 via a transport system and the transfer device 5 to a position in which the recording medium is opposed to the photosensitive drum 1. In the first embodiment, the transfer device 5 has a transfer drum 5*a* as a recording medium bearing member, a transfer charger 5*b*, an attractive charger 5*c* for electrostatically attracting a recording medium, an attractive roller 5*g* which is opposed to the attractive charger 5*c*, an inner charger 5*d*, and an outer charger 5*e*. A dielectric recording medium bearing sheet 5*f* is cylindrically and integrally stretched in the peripheral opening region of the transfer drum 5*a* which is so axially supported as to be rotated. The recording medium bearing sheet 5*f* uses a dielectric sheet made of a polycarbonate film or the like.

As the transfer drum 5*a* rotates, the toner image on the photosensitive drum 1 is transferred by the transfer charger 5*b* onto a recording medium borne by the recording medium bearing sheet 5*f*.

In this manner, a desired number of color images are transferred to the recording medium attracted and transported by the recording medium bearing sheet 5*f* to form a full-color image.

In a four-color mode, after four color toner images are transferred, the recording medium is stripped from the transfer drum 5*a* by the operation of a stripping claw 8*a*, a stripping upthrust runner 8*b*, and a stripping charger 5*h*. The recording medium is delivered to a tray 10 via a thermal roller fixing device 9.

The residual toner on the surface of the photosensitive drum 1 after transfer is cleaned by the cleaning device 6, and the photosensitive drum 1 is used for the image forming process again.

To form images on the two sides of a recording medium, a transport path switching guide 19 is driven immediately after the recording medium is delivered from the fixing device 9. The recording medium is guided to a surface reverse path 21*a* via a delivery vertical path 20 and temporarily stopped. A surface reverse roller 21*b* is reversely rotated to retract the recording medium from an edge, which is a trailing edge in transport, in a direction opposite to the transport direction. The surfaces of the recording medium are reversed and stocked in an intermediate tray 22. Thereafter, an image is formed on the other side of the recording medium by the above-described image forming process again.

The surface of the recording medium bearing sheet 5*f* on the transfer drum 5*a* is contaminated by scattering and deposition of powder from the photosensitive drum 1, developing devices 4, a cleaning device 6, and the like, deposition of toner upon occurrence of a jam of a recording medium (sheet jamming), or deposition of oil on a recording medium in the two-side image formation. The recording medium bearing sheet 5*f* is therefore cleaned by the operation of a fur brush 14, a backup brush 15 which is opposed to the brush 14 via the recording medium bearing sheet 5*f*, an oil removal roller 16, and a backup brush 17 which is opposed to the roller 16 via the recording medium bearing sheet 5*f*. Then, the recording medium bearing sheet 5*f* is used for the image forming process again. This cleaning is executed in pre-rotation and post-rotation, or upon occurrence of a jam.

In the first embodiment, a transfer drum eccentric cam 25 is operated to operate a cam follower 5*i* integrated with the transfer drum 5*a*. The gap between the recording medium bearing sheet 5*f* and the photosensitive drum 1 can be set to a predetermined interval at a predetermined timing. For example, during the standby or power-off state, the transfer drum and photosensitive drum are spaced apart from each other, and the transfer drum can be rotated independently of rotation driving of the photosensitive drum.

Each developing device 4 (4*y*, 4*c*, 4*m*, 4*bk*) comprises first and second agitating and conveying means 42A and 42B, which convey developer in opposite directions. In each developing device, a developing sleeve 41 is arranged above the first agitating and conveying means 42A.

Figure 12:
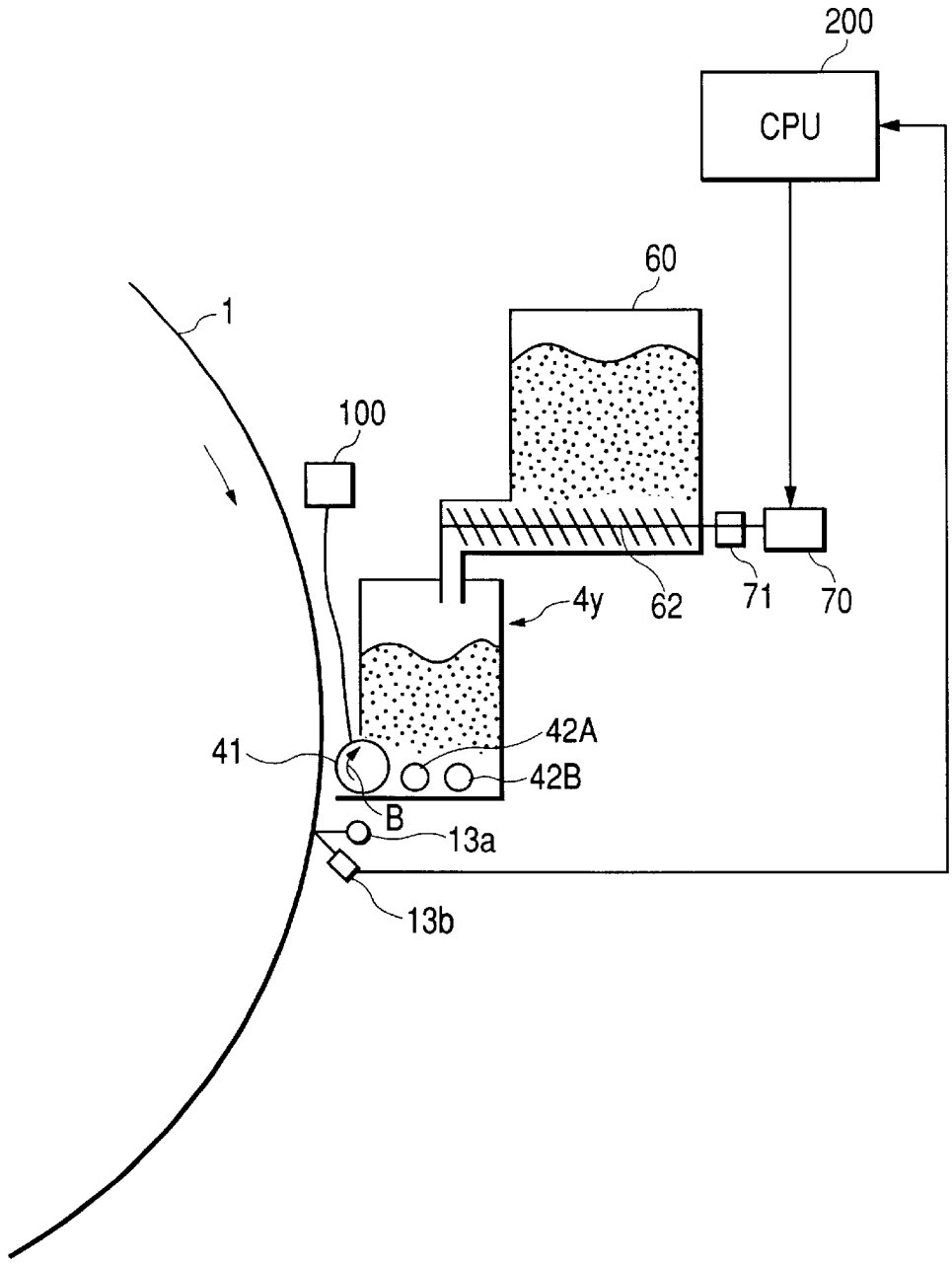
FIG. 12 is a view showing in detail a developer supplying mechanism for a developing device.

A developer supplying arrangement for each developing device will be explained by exemplifying the developing device 4*y*, as shown in FIG. 12. The developing devices 4*m*, 4*c*, and 4*bk* also have the same arrangement. A hopper 60 as a developer container is connected to an upper portion of the developing device 4*y*. The developer in the hopper 60 is conveyed from an opening into the developing device 4*y* by driving a motor 70 for a predetermined time by a developer supplying signal from a CPU 200 (to be described later), and rotating and driving a supplying screw 62 together with a gear train 71. The toner/carrier ratio (ratio between toner weight and carrier weight) in each developing device can be optimized, and as a result, a proper image can be formed on the photosensitive member 1.

In the series of image forming operations, the developing device 4 operates as follows. When an electrostatic latent image reaches a developing position, a developing bias prepared by superimposing AC and DC voltages from a developing bias power supply 100 is applied to the developing sleeve 41. The developing sleeve 41 is rotated in a direction indicated by an arrow B by a developing sleeve driving device (not shown) The developing device 4 is pressurized toward the photosensitive drum by the development pressure cam 24 (24*y*, 24*c*, 24*m*, 24*bk*) to visualize the electrostatic latent image.

Figure 3:
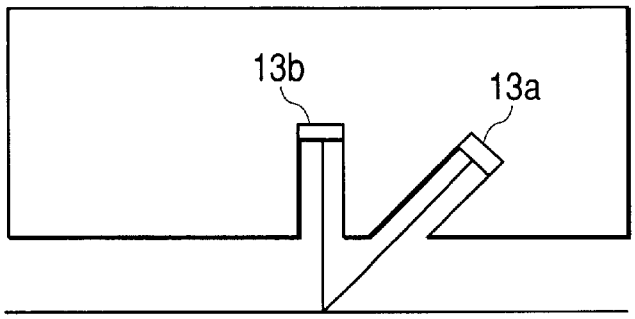
FIG. 3 is a schematic view showing a density sensor according to the first embodiment.
Figure 4:
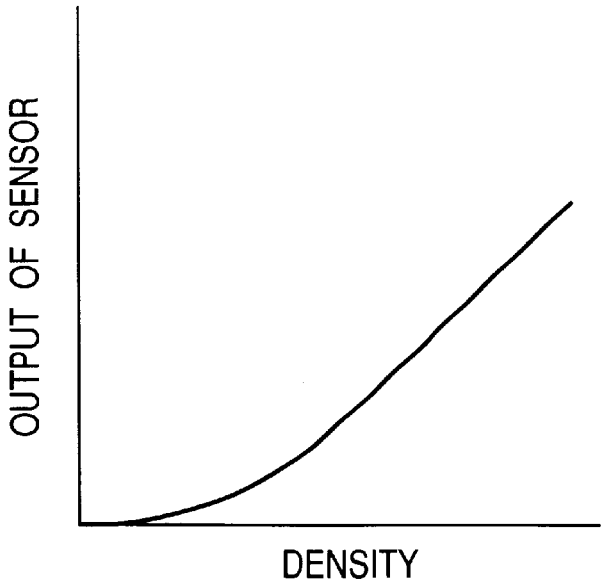
FIG. 4 is a graph showing the output of the sensor with respect to the density in the density sensor according to the first embodiment.

In the first embodiment, as shown in FIG. 2, the density detecting sensor 13 which detects diffuse reflection light from the toner image serving as a control image visualized on the photosensitive member is fixed and arranged around the photosensitive member. The density detecting sensor 13 receives light from a toner image moving relatively (together with the photosensitive member). FIG. 3 is a schematic view showing this sensor. The density detecting sensor 13 has a near infrared ray LED 13*a* as a light-emitting element, and a photodiode 13*b* as a light-receiving element. FIG. 4 is a graph showing the relationship between the toner image density and the light quantity in this sensor. The density detecting sensor 13 is connected to the CPU 200.

The CPU 200 samples outputs from the sensor 13 in a predetermined sampling cycle, and averages the input sensor outputs. Information obtained by averaging processing is compared with a predetermined target value to determine the developer supply amount. Based on the developer supply amount, the energizing time of the motor 70, i.e., the rotation time and the rotating speed of the supplying screw are determined.

The energizing time of the motor 70 serving as a supplying means for supplying developer to the developing device, i.e., the rotation time and the rotating speed of the supplying screw 62 are optimized in accordance with the detected toner image density, thereby optimizing the toner/carrier density ratio (ratio in weight between toner and carrier) in the developing device. In normal image formation, the density of a toner image is controlled to an optimal value by the CPU 200 of the control device.

In addition, at least one of a charging bias to the corona charger for forming an electrostatic latent image on the photosensitive member, the exposure amount of the exposure device, and a developing bias applied to the developing sleeve is adjusted by the control device in accordance with the detected toner image density. In normal image formation, the density of a toner image is also controlled to an optimal value by the CPU 200 of the control device.

In the present invention, the developer supplying conditions of the supplying means, the charging conditions of the charging means, the exposure conditions of the exposure means, and the developing conditions of the developing means are called an image forming condition altogether. "To control an image forming condition" means "to control at least one of the above conditions".

The characteristic feature of the present invention will be explained.

Figure 5:
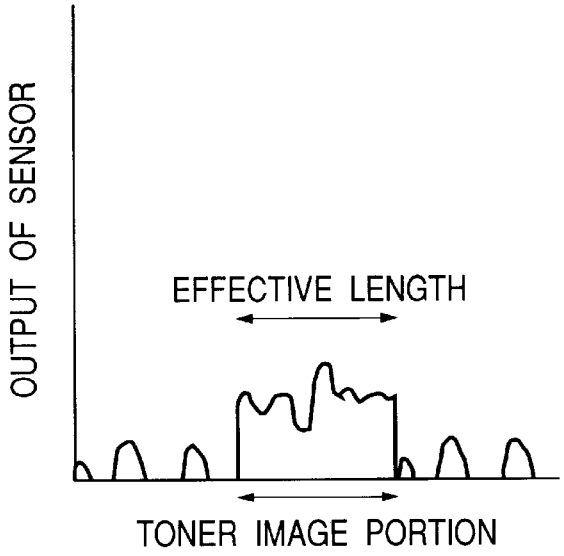
FIG. 5 is a graph showing the output of the sensor when a toner image of a density of 1.3 is detected in the first embodiment.
Figure 6:
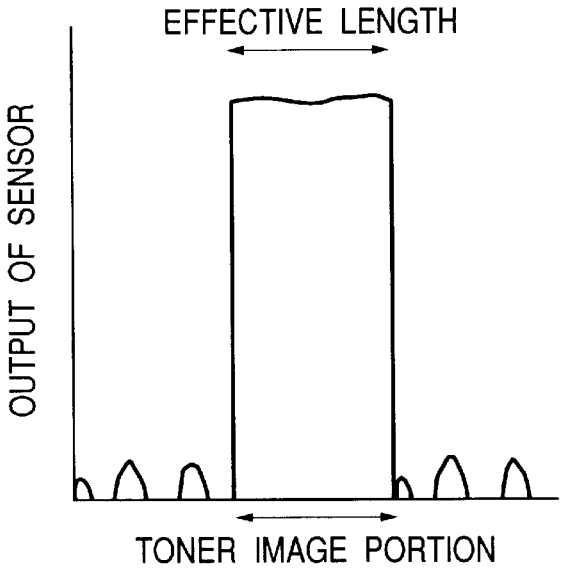
FIG. 6 is a graph showing the output of the sensor when a toner image of a density of 0.3 is detected in the first embodiment.

FIG. 5 shows a sensor output when a control image (toner image) of a density of 1.3 (dimensionless) formed on the photosensitive member is detected using the sensor. FIG. 6 shows a sensor output when a control image (toner image) of a density of 0.3 (dimensionless) formed on the photosensitive member is detected. In detection of a control image (toner image) of a low target density level formed on the photosensitive member, the sensor output varies greater than in detection of a control image (toner image) of a higher target density level.

Figure 7:
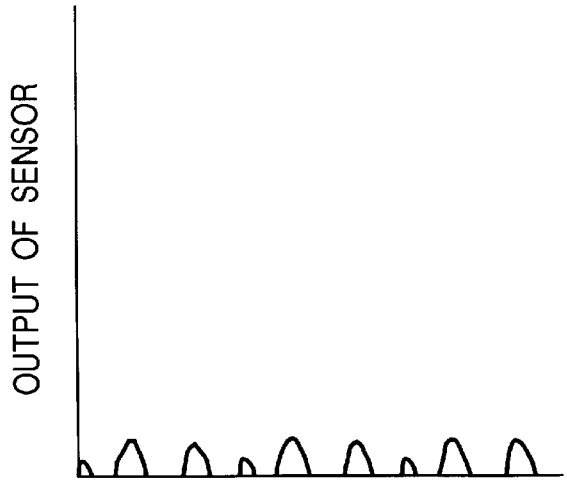
FIG. 7 is a graph showing the output of the sensor when an image bearing member is detected in the first embodiment.

The reason why the sensor output greatly varies upon detecting a low-density toner image and hardly varies upon detecting a high-density toner image is that at a low density, the sensor output is influenced by the reflectance of the surface of the photosensitive member serving as the background of a toner image. FIG. 7 shows a sensor output in the absence of toner. As is apparent from FIG. 7, the sensor output greatly varies in the absence of toner, and the output variation cycle is a photosensitive member cycle. For this reason, output variations are caused by the surface property of the image bearing member serving as a background. As the toner image density at which the background is covered is higher, output variations are smaller.

In this embodiment, the density detecting sensor 13 detects two toner images of low and high target density levels, and an image forming condition is controlled. That is, a low-density toner image is detected to control the toner/carrier ratio in the developing device, and a high-density toner image is detected to control the maximum image density to be formed on the photosensitive member.

High-accuracy detection can be achieved by increasing the size of the control image and the number of averaging points (number of sampling points) in order to reduce the above-mentioned variations in sensor output. However, forming a large toner image prolongs the time required for control (during which normal image formation cannot be done), or increases the toner amount used for the above control.

Figure 1:
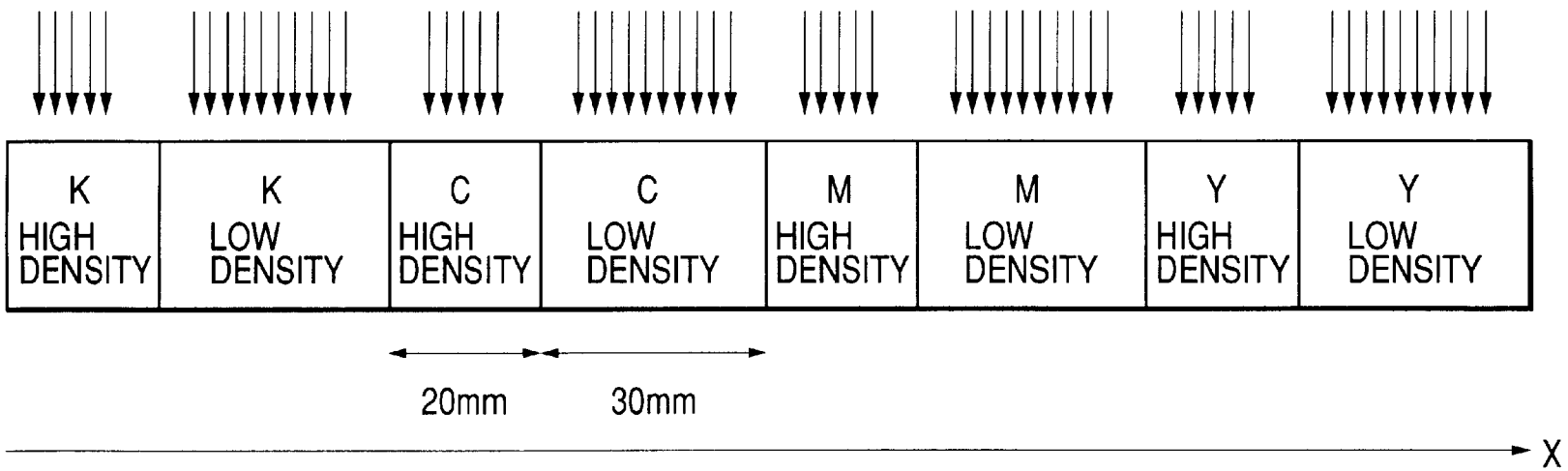
FIG. 1 is a schematic view showing the size of a density control toner image according to the first embodiment.

In the first embodiment, as shown in FIG. 1, a low-density toner image with small sensor output variations was formed larger than a high-density toner image (length of the control image in the moving direction), and the number of averaging points of the low-density toner image was increased. With this setting, the density could be detected with high accuracy without wastefully increasing the control time or the toner amount used for detection. This embodiment could control an image forming condition with high accuracy.

(Second Embodiment)

The second embodiment is an application of the first embodiment. The same parts as those in the first embodiment will be omitted.

Figure 8:
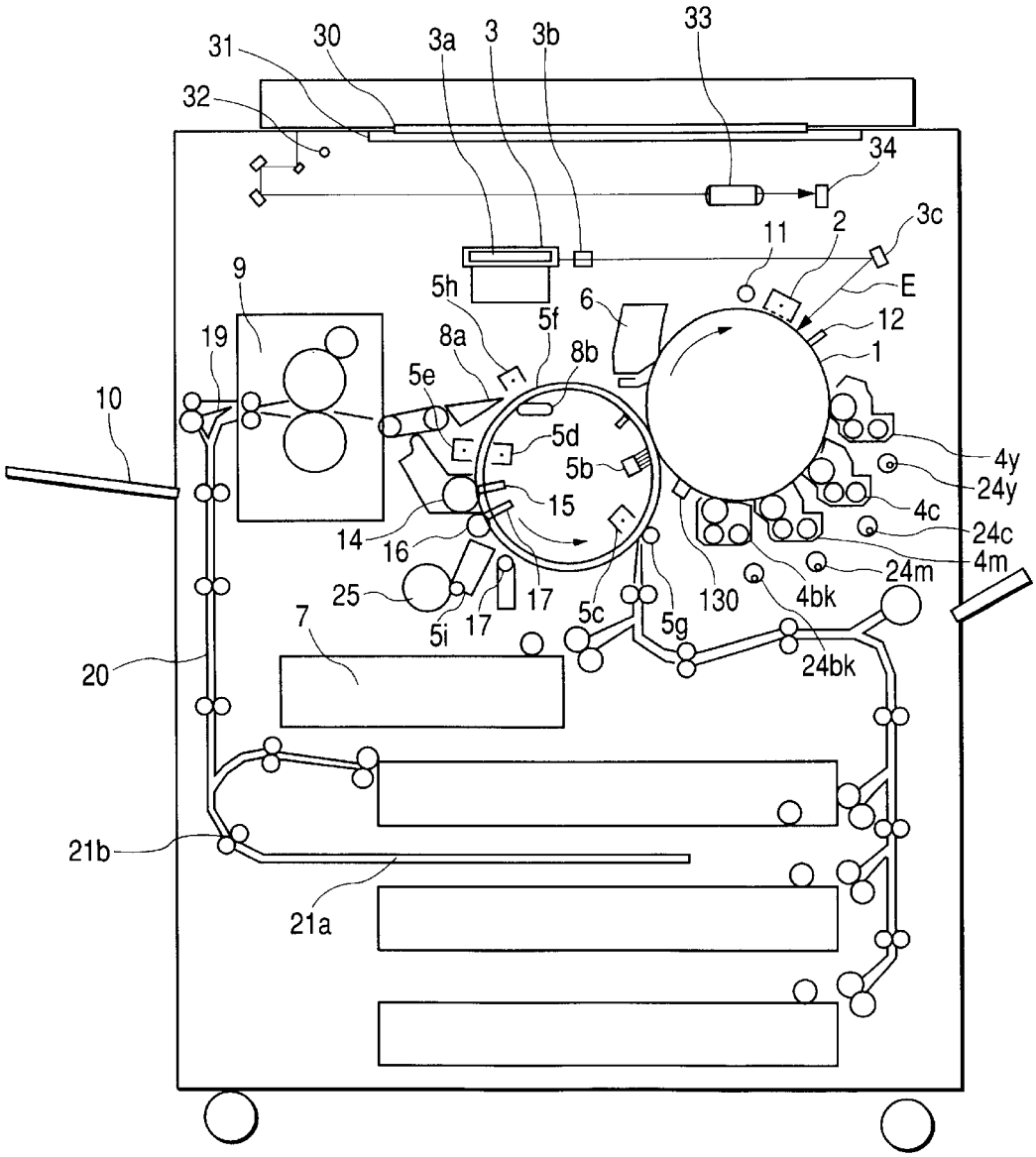
FIG. 8 is a sectional view showing the whole arrangement of an image forming apparatus according to the second embodiment.

In the second embodiment, as shown in FIG. 8, a density detecting sensor 130 which detects regular reflection light from a toner image on a photosensitive drum 1 is arranged. FIG. 9 is a schematic view showing this sensor. The density detecting sensor 130 has an LED 130*a* and a photodiode 130*b*. FIG. 10 is a graph showing the relationship between the toner image density and the light quantity in this sensor.

Compared to the diffuse reflection light sensor described in the first embodiment, the regular reflection sensor exhibits a high sensitivity at a low density. The regular reflection light sensor detects regular reflection light of a background, and thus is more readily influenced by variations in sensor output caused by the surface property of the background, as described in the first embodiment.

Also in the use of the regular reflection sensor, like the second embodiment, a low-density toner image with small sensor output variations was formed larger than a high-density toner image, and the number of averaging points of the low-density toner image was increased. The density could be detected with high accuracy without wastefully increasing the control time or the toner amount used for detection.

(Third Embodiment)

The third embodiment is another application of the first embodiment. The same parts as those in the first embodiment will be omitted.

The third embodiment controls the gradation by using a density detecting sensor 13. This control optimizes γ-LUT (control of optimizing the linearity of the density of an output image formed on a photosensitive member (recording medium) for an image density signal input to an image forming apparatus) so as to keep the gradation of a color image constant even if the environment changes or the apparatus changes over time.

In order to control γ-LUT, ten (10) control images (toner images) at image rates of 10%, 20%, 30%, 40%, 50%, 60%, 70%, 80%, 90%, and 100% for different target density levels are formed on the photosensitive member and detected by the detecting sensor.

The third embodiment stabilizes the sensor output by changing the size of the toner image (X direction in FIG. 1: toner image moving direction (photosensitive member moving direction R1)) in accordance with the target density level, as shown in the table of FIG. 11.

This processing enabled detecting the densities of low- to high-density control images with high accuracy without wastefully increasing the control time or the toner amount used for detection.

In the above embodiments, the sampling interval (cycle) of sampling an output from the detecting sensor remains the same regardless of whether the control image has a low or high density. The present invention is not limited to this, and can be applied to a case in which the sampling cycle to detect a low-density control image is set shorter than the sampling cycle to detect a high-density control image, and the number of sampling points is increased to increase the density detection accuracy.

The present invention is not limited to the arrangement of detecting the density of a control image on the photosensitive member functioning as an image bearing member, as described in the above embodiment, but can also adopt the following arrangement.

For example, the density detecting sensor 13 may be fixed and arranged on the outer surface of the recording medium bearing sheet 5*f* serving as a transfer medium, and detect a control image transferred from the photosensitive member onto the recording medium bearing sheet 5*f*. In this case, the image bearing member in the present invention corresponds to the recording medium bearing sheet.

Alternatively, in an image forming apparatus in which an image formed on the photosensitive member is primarily transferred onto an intermediate transfer member functioning as a transfer medium and the image is secondarily transferred onto a recording medium, the density detecting sensor 13 may be fixed and arranged on the outer surface of the intermediate transfer member and detect the control image on the intermediate transfer member. In this case, the image bearing member in the present invention corresponds to the intermediate transfer member.

It is also possible to form a control image on a sheet of paper serving as a recording medium, fix the image by the fixing device, and deliver the sheet outside the image forming apparatus. Then, the sheet is placed on the original glass stand 31, and scanned and exposed by the exposure lamp 32. The obtained reflection light image is read by the full-color sensor 34 serving as an image reading device via the lens 33, and the above image forming conditions are controlled. In this case, the detecting sensor corresponds to the full-color sensor 34, and the image bearing member corresponds to a sheet of paper.

In addition to these examples, the present invention can be variously modified within the spirit and scope of the invention.

As has been described above, the above embodiments can increase the density detection accuracy of a control image and appropriately control an image forming condition. By achieving stabilization of the density of an output image, variations in density and the density difference between a plurality of image forming apparatuses (individual difference) caused by degradation of the image forming apparatus over time or a change in environment can be eliminated or reduced.

What is claimed is:

1. An image forming method comprising:

forming a first image for control on an image bearing member by image forming means;

detecting a density of the first image by a detecting sensor;

forming a second image for control lower in target density level than the first image on said image bearing member by said image forming means; and detecting a density of the second image by said detecting sensor, wherein said image forming means forms the second image having a length larger in a moving direction than the first image.

2. A method according to claim 1, wherein a sampling cycle of sampling an output from said detecting sensor in detection of the first image is substantially the same as that in detection of the second image.

3. A method according to claim 2, comprising controlling an image forming condition of said image forming means in accordance with an output from said detecting sensor.

4. A method according to claim 3, wherein the first image is an image to control a maximum image density, and the second image is an image to control a developer amount supplied to a developing device.

5. An image forming apparatus comprising:

image forming means for forming an image on an image bearing member; and a detecting sensor for detecting a density of a first image for control and a density of a second image for control lower in target density level than the first image which are formed by said image forming means, wherein said image forming means forms the second image having a length larger in a moving direction than the first image.

6. An apparatus according to claim 5, wherein a sampling cycle of sampling an output from said detecting sensor in detection of the first image is substantially the same as that in detection of the second image.

7. An apparatus according to claim 6, comprising control means for controlling an image forming condition of said image forming means in accordance with an output from said detecting sensor.

8. An apparatus according to claim 7, wherein the first image is an image to control a maximum image density by said control means, and the second image is an image to control a developer amount supplied to a developing device by said control means.

9. An image detecting method comprising:

forming a first image for control on an image bearing member by image forming means;

detecting a density of the first image by a detecting sensor;

forming a second image for control lower in target density level than the first image on said image bearing member by said image forming means; and detecting a density of the second image by said detecting sensor, wherein a number of sampling points for sampling output from said detecting sensor is larger in detection of the second image than in detection of the first image.

10. A method according to claim 9, comprising controlling an image forming condition of said image forming means in accordance with output from said detecting sensor.

11. A method according to claim 10, wherein the first image is an image to control a maximum image density, and the second image is an image to control a developer amount supplied to a developing device.

12. An image forming apparatus comprising:

image forming means for forming an image on an image bearing member; and a detecting sensor for detecting a density of a first image for control and a density of a second image for control lower in target density level than the first image which are formed by said image forming means, wherein a number of sampling points for sampling output from said detecting sensor is larger in detection of the second image than in detection of the first image.

13. An apparatus according to claim 12, comprising control means for controlling an image forming condition of said image forming means in accordance with output from said detecting sensor.

14. An apparatus according to claim 13, wherein the first image is an image to control a maximum image density, and the second image is an image to control a developer amount supplied to a developing device.

15. An image forming method comprising:

forming a control image on a photosensitive member by image forming means; and detecting a density of the control image on the photosensitive member by a detecting sensor, wherein a size of the control image is changed in accordance with a target density level of the control image.

16. An image forming method comprising:

forming a control image on a photosensitive member by image forming means; and detecting, by a detecting sensor, a density of the control image on a transfer medium, the control image being transferred from said photosensitive member, wherein a size of the control image is changed in accordance with a target density level of the control image.

17. An image detecting method comprising:

forming a control image on a photosensitive member by image forming means; and detecting a density of the control image on the photosensitive member by a detecting sensor, wherein a number of sampling points for sampling output from said detecting sensor is changed in accordance with a target density level of the control image.

18. An image detecting method comprising:

forming a control image on a photosensitive member by image forming means; and detecting, by a detecting sensor, a density of the control image on a transfer medium, the control image being transferred from said photosensitive member, wherein a number of sampling points for sampling output from said detecting sensor is changed in accordance with a target density level of the control image.

* * * * *

UNITED STATES PATENT AND TRADEMARK OFFICE

CERTIFICATE OF CORRECTION

PATENT NO. : 6,731,888 B2
DATED : May 4, 2004
INVENTOR(S) : Kazuo Suzuki et al.

It is certified that error appears in the above-identified patent and that said Letters Patent is hereby corrected as shown below:

Column 4,
Line 5, “two-side” should read -- two-sided --.

Column 8,
Lines 16 and 60, “are” should read -- is --.

Signed and Sealed this

Twenty-first Day of December, 2004

JON W. DUDAS
*Director of the United States Patent and Trademark Office*